US011273666B1

(12) United States Patent
Moufawad

(10) Patent No.: US 11,273,666 B1
(45) Date of Patent: Mar. 15, 2022

(54) PENCIL SHARPENER

(71) Applicant: Samir Moufawad Moufawad, Mazraat Yashouh (LB)

(72) Inventor: Samir Moufawad Moufawad, Mazraat Yashouh (LB)

( * ) Notice: Subject to any disclaimer, the term of this patent is extended or adjusted under 35 U.S.C. 154(b) by 0 days.

(21) Appl. No.: 17/234,853

(22) Filed: Apr. 20, 2021

(51) Int. Cl.
*B43L 23/08* (2006.01)
*B43L 23/04* (2006.01)

(52) U.S. Cl.
CPC ..... *B43L 23/08* (2013.01); *B43L 23/04* (2013.01)

(58) Field of Classification Search
CPC ..... B43L 23/08; B43L 23/04
USPC ..... 30/451, 454, 461
See application file for complete search history.

(56) References Cited

U.S. PATENT DOCUMENTS 3,851,687 A * 12/1974 Jones ..... B43L 23/06 30/451
6,334,475 B1 * 1/2002 Schultheiss ..... B43L 23/04 144/28.1
2013/0147104 A1 * 6/2013 Saito ..... B43L 23/008 269/218
2017/0050462 A1 * 2/2017 Jones ..... B43L 13/008

* cited by examiner

*Primary Examiner* — Omar Flores Sanchez

(57) ABSTRACT

The present invention is a pencil sharpener or the like such as a makeup pen. It uses two handles similar to a pair of pliers. In one configuration, pressing the two handles advances oblique sharp tip blades which cut through the wood and core of a pencil. The result is that the pencil is sharpened in one press of the handles. The second configuration has even number of blades. With two blades, it requires the handles to be pressed a second time after manually rotating the pencil 90 degrees. With 4 blades, each two opposing blades cut through the pencil in half the pressing interval. With 6 blades, each two opposing blades cut through the pencil in one third the pressing internal, and so on.

12 Claims, 4 Drawing Sheets

PENCIL SHARPENER

BACKGROUND OF THE INVENTION

Field of the Invention

Embodiments of the invention described herein pertain to the field of stationary. More particularly, but not by way of limitation, one or more embodiments of the invention enables a pencil sharpener or the like such as makeup pen, with two handles and oblique moving blades.

Description of the Related Art

Manual pencil sharpeners are available and do well in sharpening a pencil. Some are simple where the pencil is rotated by hand. In this case, many rotations are needed because the layers of wood being cut are thin. Others have a crank which provides easy sharpening but such sharpeners are bulky and not portable. Patent number CN108327432 uses two handles, but also requires many rotations.

It is noticeable when using a pencil that frequent sharpening is needed due to the core braking or needing sharpening. Therefore, a more practical and easier to use sharpener is indeed advantages.

BRIEF SUMMARY OF THE INVENTION

The present invention is a pencil sharpener or the like such as a makeup pen. It uses two handles similar to a pair of pliers. The handles are rotationally coupled at portions of one of their ends. One portion has blade actuators and the other portion has oblique guides for the blades. The blades move in an oblique manner toward the section of the pencil which needs sharpening. The purpose of the invention is to provide a sharpener which sharpens the pencil with one press of the handles, or max two presses.

With one configuration, pressing the two handles advances oblique sharp tip blades toward the pencil. Then the blades cut through the wood and core of the pencil. The result is that the pencil is cut and sharpened in one press of the handles.

The second configuration has even number of blades. With two blades, it requires the handles to be pressed a second time after manually rotating the pencil 90 degrees. With 4 blades, each two opposing blades cut each in half the pressing interval. With 6 blades, each two blades cut in one third the pressing internal and so on.

BRIEF DESCRIPTION OF THE DRAWINGS

The above and other aspects, features and advantages of the invention will be more apparent from the following more particular description thereof, presented in conjunction with the following drawings wherein:

FIG. 1B is a diagram of an exemplary embodiment with portions of the two handles' ends comprising holes in accordance with the pencil sharpener described herein.

FIG. 1C is a diagram of an exemplary embodiment with portions of the two handles' ends coupled through a threaded sleeve and a nut in accordance with the pencil sharpener described herein.

DETAILED DESCRIPTION

The pencil sharpener will now be described using exemplary embodiments of the invention. It will be apparent to an ordinary skilled in the art person that the present invention may be practiced without incorporating all its aspects herein. Readers should note that although examples of the invention are set forth herein, the claims, and the full scope of any equivalents, are what define the metes and bounds of the inventions.

Figure 1:
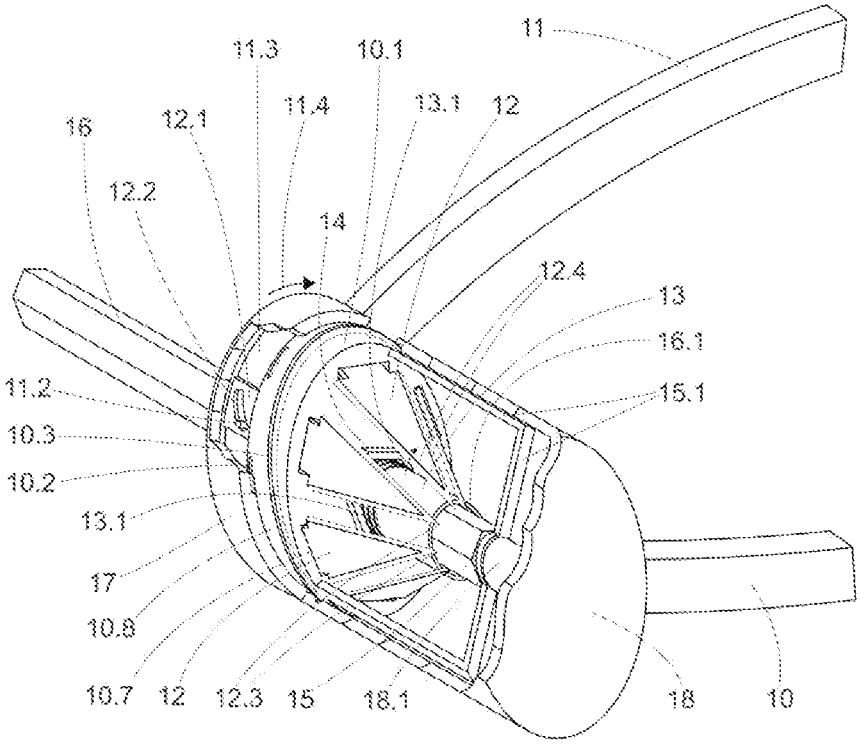
FIG. 1 is a diagram of an exemplary embodiment with two handles and oblique sharp tip blades in accordance with the pencil sharpener described herein.

FIG. 1 is a diagram of an exemplary embodiment with two handles and oblique sharp tip blades in accordance with the pencil sharpener described herein.

Handle 11 includes an actuating portion 11.1 (shown in FIG. 1B) disposed at or near one of its end. Actuating portion 11.1 includes a hole 13.2, and pins, studs or screws 11.2 on its outer circumference 11.3. Sleeve 13 is coupled to or an integral part of actuating portion 11.1. Handle 10 includes a guiding portion 10.1 disposed at or near one of its end. Guiding portion 10.1 includes a hole 10.12 which is aligned 13.3 with hole 13.2 (shown in FIG. 1B) where pencil 16 is inserted.

Guiding portion 10.1 is rotationally coupled to actuating portion 11.1 by nut 14 engaging thread 13.1 as shown in FIG. 1C. Guiding portion 10.1 has oblique guides 10.7 which allow blades 12 to slide in. Thread 10.3 on the outer circumference 10.8 allows locking of debris cover 18. Locks 10.2 on outer circumference 10.8 enable locking of cover 17. Stopper 15 is coupled to guiding portion 10.1 via links 15.1, and it sets the length of the sharpening end 16.1 to a specific size. Stud 18.1 which is coupled to cover 18 can also be used as a stop for pencil 16 to set the length of sharpening end 16.1. Therefore stopper 15 is optional and even without stud 18.1, pencil 16 can be held by hand to set the appropriate length 10.9 (shown in FIG. 2) of the sharpening end 16.1.

Blade 12 has an elongated shape with a sharp tip 12.3 toward sharpening end 16.1. Sharp tip 12.3 is where two sharp edges 12.4 meet. The other side 12.1 of blade 12 has an oblique slot 12.2. When pin 11.2 rotates clockwise 11.4, it actuates blades 12 through slot 12.2 causing blade 12 to advance in an oblique manner at an angle 13.1 between blades 12 and sleeve 13 or pencil 16.

Figure 2:
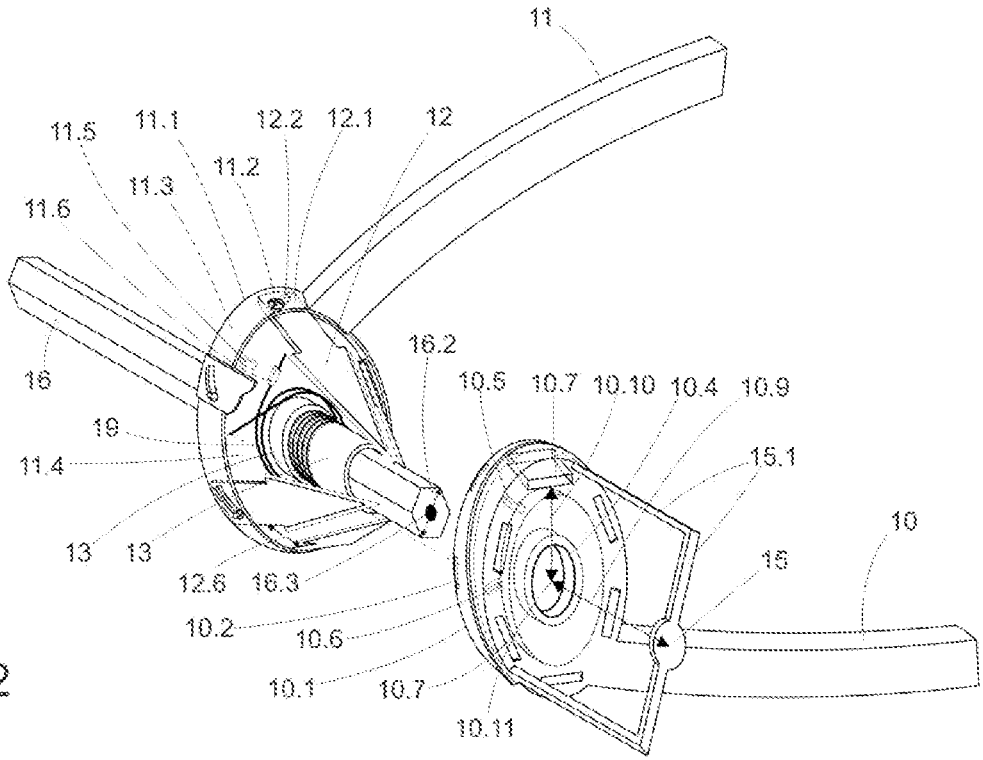
FIG. 2 is a diagram of an exemplary embodiment showing more details of two handles and oblique sharp tip blades in accordance with the pencil sharpener described herein.

FIG. 2 is a diagram of an exemplary embodiment showing more details of two handles and oblique sharp tip blades in accordance with the pencil sharpener described herein.

Oblique guides 10.7 are located a distance 10.10 from the center 10.11 of guiding portion 10.1. Actuating portion 11.1 has preferably a hollow part 11.4 between circumference 11.3 and sleeve 13. In the hollow part 11.4, stopper 11.5 will come in contact with stopper 10.5 to prevent handles 10 and 11 from further opening. Also in the hollow part 11.4, spring 19 reopens handles 10 and 11 after being released. The ends of spring 19 are held by stoppers 11.6 and 10.6.

It is preferred that blades 12 advance at the same time and are distributed at an equal distance 12.6 from each other so the cutting force exerted by sharp tip 12.3 on core 16.3 is balanced. This reduces the breakage of core 16.3.

Figure 3:
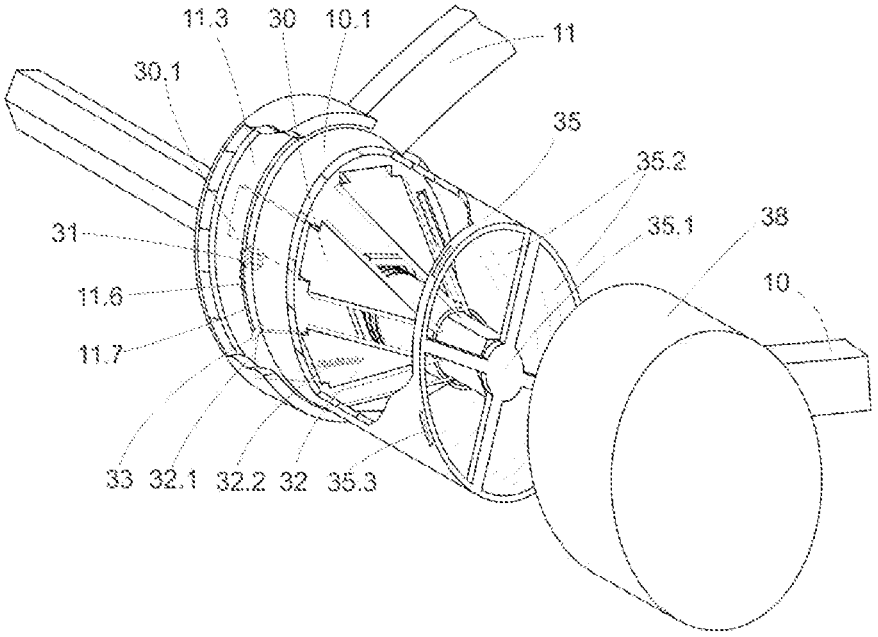
FIG. 3 is a diagram of an exemplary embodiment showing different blade actuator means in accordance with the pencil sharpener described herein.

FIG. 3 is a diagram of an exemplary embodiment showing different blade actuator means in accordance with the pencil sharpener described herein.

FIG. 3 shows more actuator means which move the blades in an oblique manner toward core 16.3, and back. Blade 30 moves by means of gear 31. Gear 31 rotates by teeth 11.6 which are formed on the edge 11.7 of circumference 11.3. In turn, gear 31 advances and retracts blade 30 through teeth 30.1. Another actuator is having pin 33 advance blade 32 through oblique edge 32.1. In this case spring 32.2 is needed to return blade 32 to its original position.

Partial enclosure 35 is coupled to or integral part of guiding portion 10.1. The purpose of enclosure 35 is for protection from all the blades. Stoppage 35.1 is to set appropriate length 10.9 of the sharpening end 16.1. Openings 35.2 are used as exist for the debris.

Cover 38 is used as a container for the debris. It is latched to enclosure 35 via locks 35.3.

Figure 4:
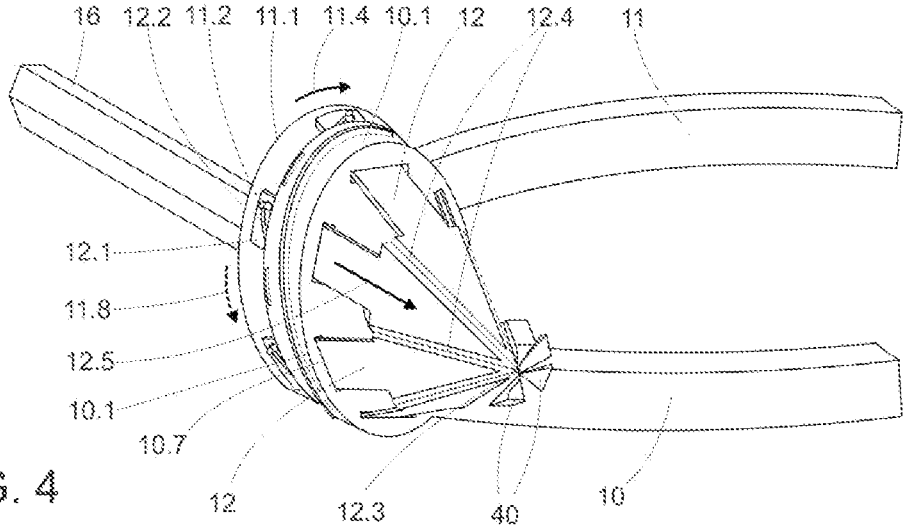
FIG. 4 illustrates an exemplary embodiment with two handles being pressed and oblique sharp tip blades sharpening a pencil in accordance with the pencil sharpener described herein.

FIG. 4 illustrates an exemplary embodiment with two handles being pressed and oblique sharp tip blades sharpening a pencil in accordance with the pencil sharpener described herein.

Figure 5A:
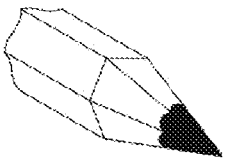
FIG. 5A is a diagram of a sharpening end of a hexagonal pencil using 6 blades in accordance with the pencil sharpener described herein.
Figure 5B:
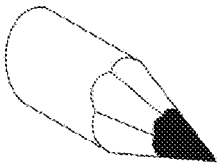
FIG. 5B is a diagram of a sharpening end of a round pencil using 6 blades in accordance with the pencil sharpener described herein.
Figure 6:
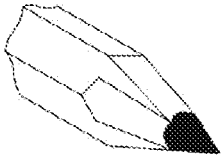
FIG. 6 is a diagram of a sharpening end using 4 blades in accordance with the pencil sharpener described herein.
Figure 7:
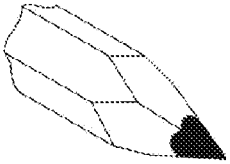
FIG. 7 is a diagram of a sharpening end using 3 blades in accordance with the pencil sharpener described herein.

When handles 10 and 11 are pressed, actuating portion 11.1 rotates clockwise 11.4 relative to guiding portion 10.1. This causes pin 11.2 to also rotate clockwise 11.4 and move through oblique slot 12.2 which causes blade 12 to slide in the direction 12.5 with its tip 12.3 toward the core center 16.3 shown in FIG. 2. With all the blades sliding through guides 10.7, tips 12.3 and sharp edges 12.4 cut through sharpening end 16.1, and removing the debris 40 in just one press of handles 10 and 11. Thus the result of sharpening end 16.1 is show in FIGS. 5A, 5B, 6 and 7. FIG. 5A shows a sharpening end 16.1 of a hexagonal pencil using 6 blades. FIG. 5B shows a sharpening end 16.1 of a round pencil using 6 blades. FIG. 6 shows a sharpening end 16.1 using 4 blades. FIG. 7 shows a sharpening end 16.1 using 3 blades.

When handles 10 and 11 are released, actuating portion 11.1 rotates counterclockwise 11.8. Then pin 11.2 rotates counterclockwise 11.8 and moves back through slot 12.2 thus returning blades 12 to its original position.

Figure 8:
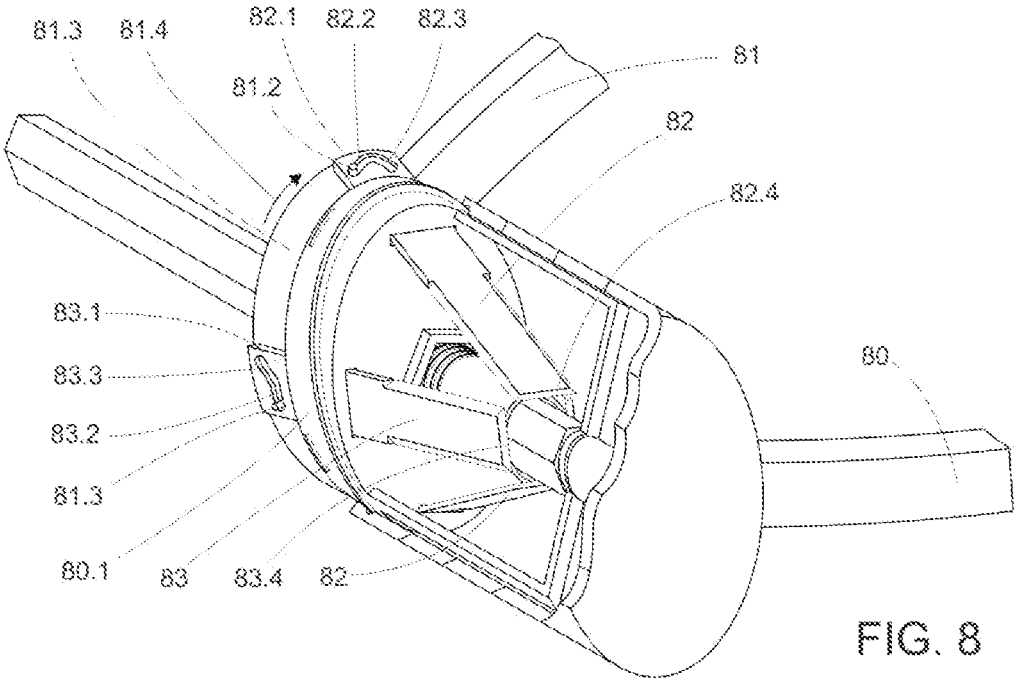
FIG. 8 is a diagram of an exemplary embodiment with two handles and even number of blades in accordance with the pencil sharpener described herein.

FIG. 8 is a diagram of an exemplary embodiment with two handles and even number of blades in accordance with the pencil sharpener described herein.

In this configuration, blades 82 and 83 have sharp front edges 82.4 and 83.4. The number of blades is even, and every two opposing blades advance in turn. When two opposing blades retract, another two opposing blades advance. First, blades 82 advance, edges 82.4 cut, and blades 82 retract. While blades 82 are retracting, blades 83 advance and edges 83.4 cut. This is done so the blades 82 don't interfere with blades 83.

Figure 9:
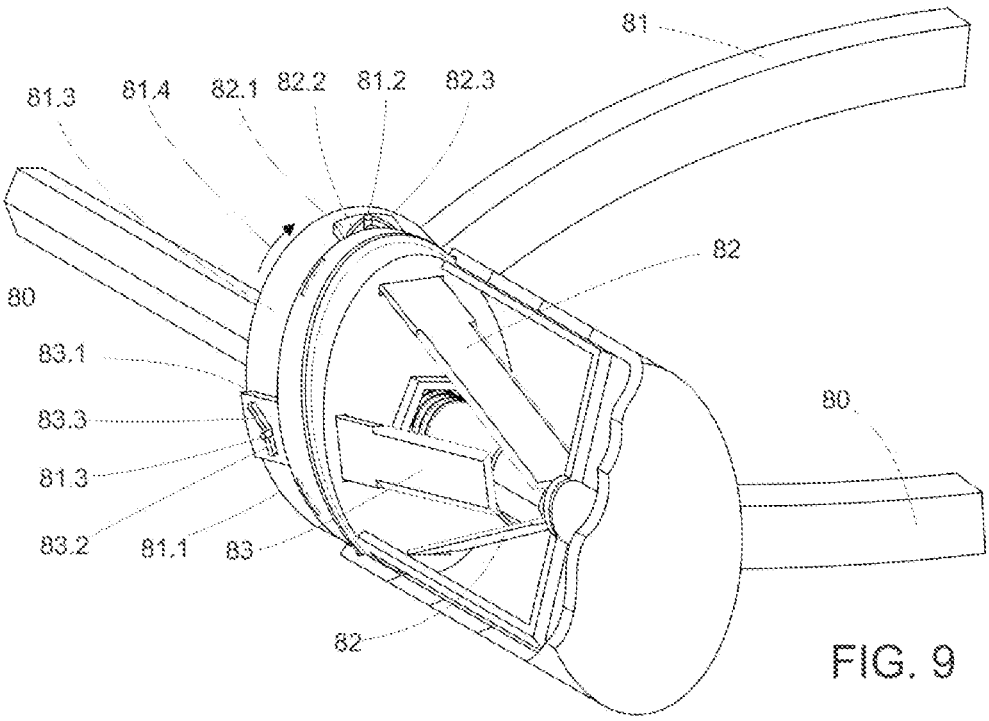
FIG. 9 illustrates an exemplary embodiment with two handles and two opposing blades advancing in accordance with the pencil sharpener described herein.

FIG. 9 illustrates an exemplary embodiment with two handles and two opposing blades advancing in accordance with the pencil sharpener described herein.

Figure 11:
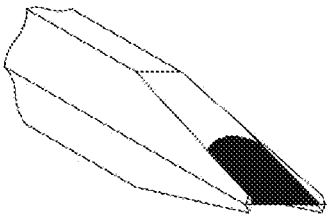
FIG. 11 is a diagram of a sharpened pencil end using 2 blades with small size sharp front edge in accordance with the pencil sharpener described herein.
Figure 12:
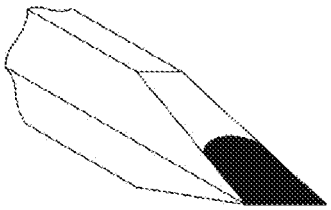
FIG. 12 is a diagram of a sharpened pencil end using 2 blades with large size sharp front edge in accordance with the pencil sharpener described herein.

When handles 80 and 81 are pressed, actuating portion 81.1 rotates clockwise 81.4. This causes pin 81.2 to also rotate clockwise 81.4 and move through slot 82.2 which causes blades 82 to advance. However, blades 83 do not advance since slot 83.2 is not oblique. The result is shown in FIG. 11 if front edge 82.4 is less than diameter 16.2 of pencil 16 shows in FIG. 2. If front edge 82.4 is equal or bigger than diameter 16.2, then the result will be as in FIG. 12.

Figure 10:
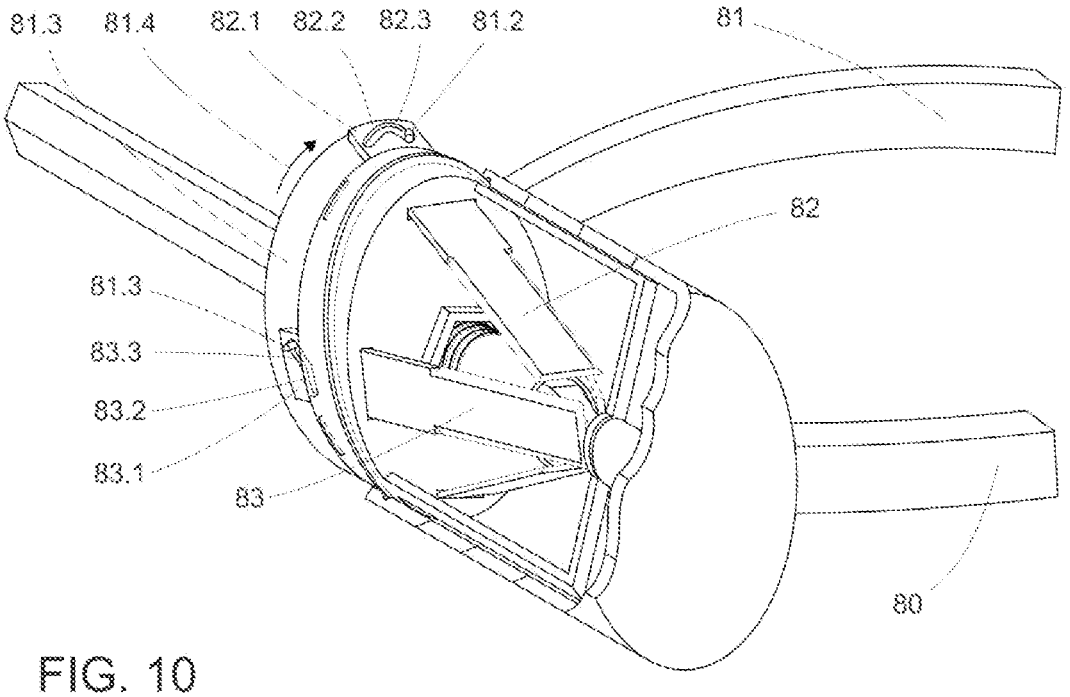
FIG. 10 illustrates an exemplary embodiment with two handles and another two opposing blades advancing in accordance with the pencil sharpener described herein.

FIG. 10 illustrates an exemplary embodiment with two handles and another two opposing blades advancing in accordance with the pencil sharpener described herein.

With further pressing of handles 80 and 81, pins 81.2 and 81.3 rotate more clockwise 81.4. Pin 81.2 will move through oppositely oblique slot 82.3 causing blades 82 to retract giving way to blades 83 to advance. Blades 83 will advance since pin 81.3 will move through oblique slot 83.3. The result will be as in FIG. 6 if the total number of blades is 4, and as in FIG. 5A and FIG. 5B if the total number of blades is 6.

Unlike the traditional pencil sharpeners, the pencil sharpener of the present invention provides a quick way to sharpen a pencil with just one press of the two handles. With three or more sharp tip blades one simple actuation of the blades will cut through and sharpen the pencil. This is quicker and less work than removing a thin layer of the pencil with many rotations. A pencil sharpener with 4 or more even number of blades will sharpen the pencil by sequential advancement of two blades at a time. The result is a sharpened pencil with only one press.

What is claimed is:

1. A pencil sharpener including:

a first handle with an actuating portion disposed at or near one end comprising a first hole;

a second handle with a guiding portion disposed at or near one end comprising a second hole, wherein said actuating portion is rotationally coupled to said guiding portion, wherein said first hole is aligned with said second hole;

two oblique guides positioned in said guiding portion on opposite sides of said second hole;

two blades with sharp front edges movable in said two oblique guides; and two actuator mechanisms coupled to said actuating portion and said two blades.

2. A pencil sharpener including:

a first handle with an actuating portion disposed at or near one end comprising a first hole;

a second handle with a guiding portion disposed at or near one end comprising a second hole, wherein said actuating portion is rotationally coupled to said guiding portion, wherein said first hole is aligned with said second hole;

at least four even number oblique guides, wherein each two of said at least four even number oblique guides are positioned in said guiding portion on opposite sides of said second hole;

at least four even number blades with sharp front edges movable in said at least four even number oblique guides; and at least four even number actuator mechanisms coupled to said actuating portion and to said at least four even number blades, wherein said at least four even number actuator mechanisms sequentially actuating two of said at least four even number blades at a time.

3. A pencil sharpener including:

a first handle with an actuating portion disposed at or near one end comprising a first hole;

a second handle with a guiding portion disposed at or near one end comprising a second hole, wherein said actuating portion is rotationally coupled to said guiding portion, wherein said first hole is aligned with said second hole;

at least three oblique guides positioned in said guiding portion at a distance from said second hole;

at least three blades with sharp tips movable in said at least three oblique guides; and a least three actuator mechanisms coupled to said actuating portion and said at least three blades.

4. The pencil sharpener of claim 1 further including at least one of a partial enclosure coupled to or is an integral part of said guiding portion or a cover for the debris coupled to said guiding portion or a cover coupled to said actuating portion.

5. The pencil sharpener of claim 2 further including at least one of a partial enclosure coupled to or is an integral part of element guiding portion or a cover for the debris coupled to said guiding portion or a cover coupled to said actuating portion.

6. The pencil sharpener of claim 3 further including at least one of a partial enclosure coupled to or is an integral part of said guiding portion or a cover for the debris coupled to said guiding portion or a cover coupled to said actuating portion.

7. The pencil sharpener of claim 1 further including at least one of a spring coupled to said actuating portion and said guiding portion or a stop mechanism coupled to said actuating portion and said guiding portion or a stop mechanism for the pencil coupled to said guiding portion.

8. The pencil sharpener of claim 2 further including at least one of a spring coupled to said actuating portion and said guiding portion or a stop mechanism coupled to said actuating portion and said guiding portion or a stop mechanism for the pencil coupled to said guiding portion.

9. The pencil sharpener of claim 3 further including at least one of a spring coupled to said actuating portion and said guiding portion or a stop mechanism coupled to said actuating portion and said guiding portion or a stop mechanism for the pencil coupled to said guiding portion.

10. The pencil sharpener of claim 4 further including at least one of a spring coupled to said actuating portion and said guiding portion or a stop mechanism coupled to said actuating portion and said guiding portion or a stop mechanism for the pencil coupled to said guiding portion.

11. The pencil sharpener of claim 5 further including at least one of a spring coupled to said actuating portion and said guiding portion or a stop mechanism coupled to said actuating portion and said guiding portion or a stop mechanism for the pencil coupled to said guiding portion.

12. The pencil sharpener of claim 6 further including at least one of a spring coupled to said actuating portion and said guiding portion or a stop mechanism coupled to said actuating portion and said guiding portion or a stop mechanism for the pencil coupled to said guiding portion.

* * * * *